United States Patent [19]

Geiger

[11] 4,283,868

[45] Aug. 18, 1981

[54] IRONING MANGLE WITH PNEUMATICALLY PRESSURIZABLE ROLLER COVERING

[75] Inventor: Friedrich Geiger, Todtenweis, Fed. Rep. of Germany

[73] Assignee: Kleindienst GmbH & Co. Kg, Augsburg, Fed. Rep. of Germany

[21] Appl. No.: 44,589

[22] Filed: Jun. 1, 1979

[30] Foreign Application Priority Data

Jun. 3, 1978 [DE] Fed. Rep. of Germany ..... 2824479

[51] Int. Cl.[3] ..... D06F 63/00; D06F 71/36; D06F 83/00

[52] U.S. Cl. ..... 38/56

[58] Field of Search ..... 38/56, 66

[56] References Cited

U.S. PATENT DOCUMENTS 4,128,953 12/1978 Geiger ..... 38/56

FOREIGN PATENT DOCUMENTS 805339 12/1958 United Kingdom ..... 38/56

*Primary Examiner*—Louis Rimrodt

*Attorney, Agent, or Firm*—Karl F. Ross

[57] ABSTRACT

An ironing mangle has an ironing roller having a generally cylindrical outer surface and rotatable about a roller axis in a predetermined rotational sense. A two-part sleeve substantially completely surrounds this roller and has a cylindrical inner surface juxtaposed with and spaced radially outwardly from the outer surface of the roller. This sleeve is formed with axially extending and angularly spaced intake and output slots subdividing it into an angularly large main part and an angularly small minor part. The main part is heated and is of thermally conductive material whereas the minor part is of insulating material. At least one inflatable cushion lies on the outer surface and is pressurizable to press items to be ironed against the inner surface of the main part of the sleeves as the arrangement is rotated. The main part has an angular dimension of more than 180° but the space between its two edges which form the respective sides of the input and output slots is sufficiently wide to permit radial removal of the ironing roller with the bags deflated.

10 Claims, 1 Drawing Figure

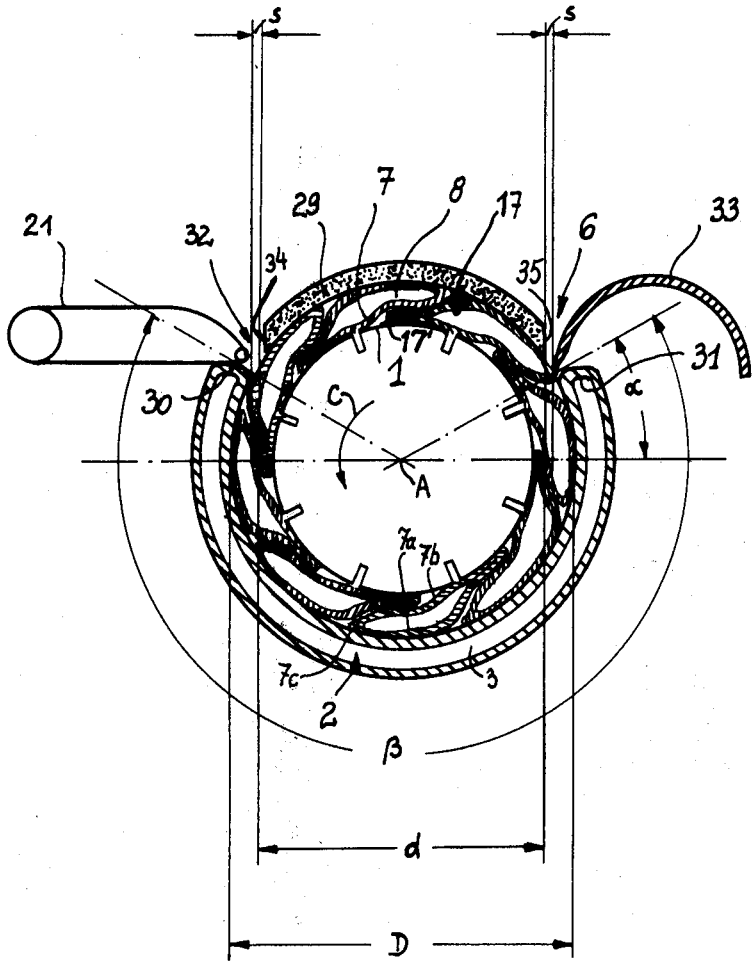
s
s
21
32
34
29
7
8
17
6
33
35
17
1
31
30
C
α
A
7a
7b
7c
2
3
β
d
D

IRONING MANGLE WITH PNEUMATICALLY PRESSURIZABLE ROLLER COVERING

FIELD OF INVENTION

The present invention relates to an ironing mangle with a pneumatically pressurizable roller covering. More particularly this invention concerns such a device used for commercially ironing large flat items.

BACKGROUND OF THE INVENTION

My U.S. Pat. No. 4,128,953 discloses an ironing mangle having a generally cylindrical and tubular roller received in a generally cylindrical tube that surrounds it by more than 270°. A plurality of cushions or bags is secured to the outer surface of the roller with these bags angularly offset and angularly overlapping each other. In addition these bags can be pneumatically pressurized to force items being ironed against the inner surface of the sleeve. A cover sheet extending circumferentially completely around the roller is secured to the roller at its leading edge underneath one of the bags and is gas pervious. Similarly the bags are provided with tubular throughgoing fittings that allow gas passage through the bags without depressurization of them, while the surfaces of these bags are formed with bumps and the roller has throughgoing holes that allow the interior of the roller to be depressurized to draw off steam generated during ironing.

Such an arrangement has proven extremely satisfactory for ironing, in particular in a commercial plant where large sheets and the like must be handled in a mass-production manner. The provision of a plurality of separately pressurized cushions ensures that the outer surface of the ironing roller remains relatively smooth for best ironing.

This system has, however, some disadvantages. In order to service, that is repair or clean, the ironing roller it is necessary to disassemble the tube or sleeve surrounding it, as it is normally impossible to pull the central roller axially out of this sleeve or tube. This operation therefore requires substantial disassembly of the entire apparatus, so that the downtime will be considerable. Another disadvantage is that the device consumes considerable heat, mainly lost at the open gap between the intake and output location. What is more the cushions frequently swell up considerably at this open gap, forming wrinkles in the cover or simply themselves expanding to such a point that the elastic limit of the material forming these cushions is exceeded. In order to prevent this it is, therefore, necessary to work with relatively low pressure in these cushions, with correspondingly reduced ironing efficiency.

OBJECTS OF THE INVENTION

It is therefore an object of the present invention to provide an improved ironing mangle.

Another object is to provide such a mangle which is more heat efficient than the prior-art mangles.

Yet another object is to provide an ironing mangle which can be serviced without having to disassemble the apparatus.

SUMMARY OF THE INVENTION

These objects are attained according to the instant invention in an ironing mangle of the above-described general type, but wherein the sleeve substantially completely surrounds the roller and is formed of two parts.

This sleeve is formed with axially extending and angularly spaced intake and output slots that subdivide it into an angularly large main part and an angularly small minor part. According to this invention the minor part is rigid and of insulating material, and has the same internal radius of curvature as the main part. Thus the internally heated ironing roller is completely surrounded except at the relatively narrow intake and output slots which, according to the instant intion, have an angular dimension of at most 10°. With this system, therefore, the bags or cushions can be filled with a fluid, normally steam, under very high pressure, as these bags are pressed inwardly at all times except when they cross the relatively narrow intake and output slots. The fatigue of the material constituting the cushions is therefore largely eliminated. At the same time the inner roller is not exposed to the atmosphere at the window formed between the edges of the main part, so that its heat is not wasted at this location by dissipation into the surrounding atmosphere. What is more, the rubbing of the inner roller against the inner surface both of the main part and of the minor part creates friction which further heats the inner roller and therefore augments the heat already applied to this inner roller and normally also to the main part of the outer tube or sleeve.

According to this invention the main part need not have an angular dimension as great as in my above-cited patent, that is more than 270°. Instead a substantially smaller angle can be used, normally exceeding 180°. The increased pressure one can use inside the cushions with the system according to my present invention coupled with the heat efficiency make such a limited angle as effective as the larger angle of my above-cited patent. It is noted in this context that in most prior-art systems the angle is only approximately 165°.

According to yet another feature of this invention the edges of the main part which define the respective sides of the intake and output slots form a window that is normally closed by the minor part and has a width measured in a straight line perpendicular to the edges which is equal at least to the diameter of the rollers plus twice the thickness of the inner walls and twice the thickness of the outer walls. Thus it is possible, even with a major part having an angular dimension of considerably more than 180°, to radially pass the inner roller with the cushions carried thereon out of the surrounding sleeve. One can also make the main part of the sleeve as a single integral part of one piece, considerably reducing manufacturing costs. It is of course also possible to make, the main part of several pieces, in which case one will still never need to disassemble it to gain access to the roller enclosed by it. Thus for access to the inner ironing roller one need merely remove the minor part of the sleeve and lift the roller therefrom after depressurizing the cushions. As this minor part is itself not heated, removing it for access to the inner roller is a relatively simple task.

According to further features of this invention each of these cushions, as in the above-cited patent, is secured relative to the rotational sense of the roller at only its leading edge to the roller, and overlaps at its trailing edge the leading edge of the following cushion. Thus the entire periphery of the roller is provided with a pneumatic covering, but each cushion only overlays a fraction of the surface area of the roller. Thus the strain at the attachment location of any single cushion is relatively small so that an extremely long service life is obtained. Furthermore since the cushions are relatively short measured circumferentially and are formed of inelastic material they will inherently lie perfectly flat, overlapping one another as described above, and will therefore prevent the formation of wrinkles in the items being ironed. Such wrinkle-formation is further reduced according to this invention by overlying the outer walls of all these cushions with a single cover sheet of felt, molten, or similar compressible and gas-pervious materials. The cover sheet itself is secured only at its leading edge to the drum at a location underlying one of these cushions, so that telegraphing of any surface irregularities to the items to be ironed is completely ruled out.

According to another feature of this invention the roller is cylindrically tubular and is formed on its surface with a multiplicity of angularly and axially spaced throughgoing holes. The surfaces of the inner and/or outer walls of the pneumatic cushions are formed with alternate bumps and recesses. Thus if the interior of the roller is aspirated, that is subject to a lower pressure than atmospheric, steam flow radially inwardly past the cushions and through the roller will be possible. Such steam aspiration is further aided by providing each of the cushions with a plurality of throughgoing fittings, each formed as a radially extending bellows-like tube having inner and outer ends sealed to the respective inner and outer walls of the respective cushions to form a throughgoing passage extending through the cushion but not communicating with its interior. Thus even in an air-pressure system good steam aspiration is possible even though the cushions or bags have walls constituted by gas-pervious and inelastic sheet metal.

According to yet another feature of this invention and endless pressing band has a stretch guided over the surrounded portion of the roller and normally lying between the items being pressed and the cover sheet of the roller. To this end the pressing band may be constituted of thin and inelastic synthetic-resin material which is made gas pervious either by perforation or by formation of an appropriate foraminous material. Such a pressing band therefore enters the apparatus according to this invention at the intake slot and leaves it at the output slot.

BRIEF DESCRIPTION OF THE DRAWING

The sole FIGURE of the drawing is a cross section through an apparatus according to this invention.

SPECIFIC DESCRIPTION

As shown in the drawing an ironing mangle according to the present invention basically comprises a cylindrically tubular roller or drum 1 centered on a horizontal axis A and surrounded by a two-part fixed sleeve having a main part 2 and a minor part 29. The main part 2 is formed with a heating chamber 3 which extends its full axial length which is equal to that of the roller 1. This chamber 3 is normally filled with steam or may be provided with resistance heaters. The main part 2 is formed relative to a normal rotation direction C of the drum 1 about the axis A with an upstream edge 30 and a downstream edge 31 respectively forming an intake slot 32 and an output slot 6 with the adjacent edges 34 and 35 of the minor shell part 29. An arcuate plate 33 is provided at the outlet 6 and serves to carry away the ironed items.

The roller 1 is provided with eight identical cushions or bags 7 having as described in my above-cited patent outer walls *7a* and inner walls *7b* joined together at a periphery *7c*. These walls *7a* and *7b* may be constituted completely of inelastic or slightly elastic material, but in any case are made gas-impervious so that they form a pressurizable chamber 8 that can be filled with air under pressure. The walls *7a* and *7b* are formed with a multiplicity of small bumps and the cushions 7 are secured at their leading edges to the drum 1.

A felt or molten cover sheet 17 has its leading edge 17' screwed to the drum 1 underneath one of the bags 7 and extends out from underneath this bag 7 to wrap circumferentially completely around all of the bags 7. This cover sheet 17 has a rectified length equal to somewhat more than the circumference of the inside wall of the sleeve formed by the parts 2 and 29. Thus the outer walls *7a* of the bags 7 do not directly contact items being ironed, which are fed in via an input conveyor 21.

The interior of the roller 1 may be aspirated and the bags 7 may be fitted with throughgoing nipples as described in my above-cited patent to carry off steam generated during ironing. In addition the system may be provided with a guide belt that normally lies between the items being ironed and the outer surface of the cover sheet 17. Such a guide belt aids in stripping the items being ironed from the drum 1.

According to this invention the main part 2 has an angular dimension $\beta$ equal to 180° plus twice an acute angle $\alpha$. The diameter D of this main part 2 is equal here to 1000 mm and the diameter d of the inner roller 1 plus twice the thickness of the flattened bags 7 is here equal to 900 mm. With this arrangement the angle $\alpha$ is equal to 200°, so that the angle $\beta$ is equal to 20°. This leaves a play s in the window formed by the edges 30 and 31 so that the roller 1 carrying its bags 7 can be withdrawn radially, here upwardly, from the main part 2. This play s is here equal to 20 mm. The following formula illustrates the relationship between these various factors: T,0100

A standard mangle of the type received in a channel-shaped sleeve is surrounded by approximately 165°. According to this invention it is possible to increase, therefore, the angle by approximately 33%. In addition the minor part 29 is of rigid but thermally insulating material having a diameter of curvature equal to D, the same as the main part 2. The use of this element 20 increases the efficiency by another 10%, so that extremely good heat transfer to the items being ironed as well as heat conservation within the device is ensured. At the same time the use of this element 29 allows the bags 7 to be pressurized with considerably higher pressure for best ironing effect. The rubbing of these bags 7 via the sheet 17 on this minor part 29 of part-cylindrical shape creates friction which further adds heat to this system so that the ironing mangle is extremely effective and efficient.

It is possible to form the main part 2 of several pieces for ease of construction. Nonetheless for servicing of the main roll 1 it is possible to take this main roll 1 completely outside of the main part 2 without having to substantially disassemble the device. The minor part 29 need merely be disconnected and moved out of the way, whereupon the roll 1 with its bags 7 deflated can be lifted right out of the window formed between the edges 30 and 31. In addition the eight bags 7 can be replaced by a single elongated bag if desired. The bags 7 could have gas-pervious walls so that they could be pressurized with steam or extremely hot gas which would leak out and serve to iron the items fed into the device by the input conveyor 21.

I claim:

1. An ironing mangle comprising:

an ironing roller having a generally cylindrical outer surface and rotatable about a roller axis in a predetermined rotational sense;

a two-part sleeve substantially completely surrounding said roller and having a cylindrical inner surface juxtaposed with and spaced radially outwardly from said outer surface of said roller, said sleeve being formed with axially extending and angularly spaced intake and output slots subdividing it into an angularly large main part and an angularly small minor part, said minor part being rigid and of insulating material;

at least one cushion having an inner wall lying mainly on said outer surface, an outer wall between said inner wall and said inner surface of said sleeve, and a sealed periphery defining between said walls a pressurizable chamber; and means for feeding a fluid under pressure into said chamber and thereby pressing an item to be pressed between said outer wall and said inner surface at said main part.

2. The mangle defined in claim 1, further comprising means for heating said main part, said main part being thermally conductive.

3. The mangle defined in claim 2, wherein said main part has a pair of edges defining respective sides of said slots and forming a window normally closed by said minor part and having a width measured in a straight line perpendicular to said edges, said width being at least equal to the diameter of said roller plus twice the thickness of said inner wall plus twice the thickness of said outer wall, said major part having an angular dimension between said edges of at least 180°.

4. The mangle defined in claim 1 wherein said main part is integrally formed of one piece.

5. The mangle defined in claim 1 wherein said roller is formed integrally of one piece.

6. The mangle defined in claim 1 wherein said slots each have an angular dimension of at most 10°.

7. The mangle defined in claim 1 wherein said main part has an angular dimension of between 210° and 220° and said roller has a diameter of between 850 mm and 950 mm.

8. The mangle defined in claim 1, further comprising a cover sheet secured to said roller and lying between said outer wall and said inner surface.

9. The mangle defined in claim 1, further comprising means for feeding items to be ironed into said intake slot and for withdrawing ironed items from said output slot.

10. The mangle defined in claim 1, further comprising means for pressurizing said cushion with a heated gas.

* * * * *